United States Patent [19]

Yoshihara et al.

[11] 3,997,301

[45] Dec. 14, 1976

[54] TIN-ELECTROPLATED STEEL SHEETS AND METHOD FOR MAKING THEM

[75] Inventors: Takahisa Yoshihara; Hajime Kimura, both of Chiba, Japan

[73] Assignee: Kawasaki Steel Corporation, Kobe, Japan

[22] Filed: Feb. 11, 1976

[21] Appl. No.: 657,071

[30] Foreign Application Priority Data

Feb. 13, 1975 Japan ..... 50-17397

[52] U.S. Cl. ..... 29/183.5; 29/195; 29/196.4; 204/29; 204/35 R; 204/37 T; 204/38 R; 204/38 S; 204/40

[51] Int. Cl.[2] ..... B23P 3/00; C25D 5/10; C25D 5/48; C25D 5/50

[58] Field of Search ..... 29/196.4, 183.5, 195 T; 204/40, 41, 37 T, 29, 35 R, 38 S, 38 R

[56] References Cited

UNITED STATES PATENTS

| | | | |
|---|---|---|---|
| 2,844,530 | 7/1958 | Wesley et al. | 204/40 |
| 3,890,164 | 6/1975 | Harada et al. | 204/37 T X |

FOREIGN PATENTS OR APPLICATIONS

| | | | |
|---|---|---|---|
| 1,568,549 | 5/1969 | France | 204/40 |

*Primary Examiner*—G. L. Kaplan

[57] ABSTRACT

A tin-electroplated steel sheet having an excellent sulfur resisting property and excellent smudge resisting property is disclosed. The tin-electroplated steel sheet comprises a cold rolled low carbon steel sheet substrate, a layer consisting of 1 to 15 g/m$^2$ of electroplated tin, said layer being electroplated upon at least one side surface of said substrate and a layer consisting of 0.0071 to 0.71 g/m$^2$ of zinc, said layer being plated upon the tin layer.

16 Claims, 1 Drawing Figure

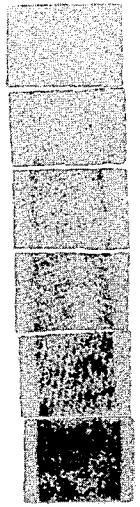

TIN-ELECTROPLATED STEEL SHEETS AND METHOD FOR MAKING THEM

This invention relates to a new and improved tin-electroplated steel sheets and more particularly to a tin-electroplated steel sheet having an excellent sulfur resisting property and excellent smudge resisting property.

The tin-electroplated steel sheet is more suited to the manufacture of cans or containers for food products.

It is important that cans or containers for food products shall be highly sulfur resistant and free from surface discoloration into black due to tin sulfide.

It has been found that the above desired sulfur resisting property could not be given to a conventional tin-electroplated steel sheet obtained by a conventional method which comprises successive steps of electroplating a steel sheet with tin, reflowing the tin-electroplated steel sheet and chemically treating, for example, electrolytic chromate treating or dip treating the thus treated steel sheet in an aqueous solution containing hexa valent chromium ion.

In general, the surface of tin-electroplated products inclusive of cans or containers for food products is frequently printed or coated with paint. During the printing or painting treatment, however, there is a risk of the printed or painted surface being contaminated by so-called smudge mainly caused by tin powder or oxides thereof produced on the surface of the tin-plated products and adhered to a conveyor provided for a printing or painting machine.

As a result, it is also important that the tin-plated products shall be highly smudge resistant and free from surface contamination due to the presence of the smudge.

In an effort to obtain such smudge resisting property, at least one attempt has been made to coat the surface of the tin-plated product with a lubricant such, for example, as cotton seed oil or dioctyl sebacate (D.O.S.) so as to not only prevent contamination due to smudge but also prevent scratches made in the surface of the tin-plated product during its transportation or step of manufacturing it into cans. However, it has heretofore been found that such conventional measure is not complete in effect and hence it is so much requested to improve the smudge resisting property as well as scratch resisting property of the tin-plated product.

A principal object of the invention, therefore, is to provide an improved tin-electroplated steel sheet having both improved sulfur resisting property and improved smudge resisting property.

Another object of the invention is to provide a tin-electroplated steel sheet which is free from surface defects and pin-holes which have been encountered with the conventional tin-electroplated steel sheet and which is more improved in corrosion resisting property which can be determined by thiocyanate test and salt spray test and which is more improved in paint adhesive property and other surface characteristics than the conventional tin-electroplated steel sheet.

The invention is based on such recognition that a cold rolled low carbon steel sheet electroplated with 1 to 15 g/m$^2$ of tin to provide a tin layer and further plated with zinc which is extremely thin in thickness to provide a matte-finished tin-electroplated steel sheet can significantly improve both sulfur resisting property and smudge resisting property, that these improved properties can also be obtained by subjecting a reflowing treatment to the tin layer before or after the zinc plating step, and that these improved properties can further be improved by subjecting a final chemical treatment to the above treated steel sheet.

The invention will be carried out as follows.

1. At least one side surface of a cold rolled low carbon steel sheet is electroplated with 1 to 15 g/m$^2$ of tin to provide a tin layer and immediately thereafter the tin layer is plated with zinc of 0.0071 to 0.71 g/m$^2$ to provide a zinc layer superimposed on the tin layer, thereby providing a matte-finished tin-electroplated steel sheet having both excellent sulphur resisting property and excellent smudge resisting property.

2. At least one side surface of a cold rolled low carbon steel sheet is electroplated with 1 to 15 g/m$^2$ of tin to provide a tin layer and immediately thereafter the tin layer is plated with zinc of 0.0071 to 0.71 g/m$^2$ to provide a zinc layer superimposed on the tin layer. The thus treated steel sheet is subjected to a reflowing treatment in which the steel sheet is heated at a temperature above the melting point of tin, thereby providing a flow-brightened tin-electroplated steel sheet having both excellent sulphur resisting property and excellent smudge resisting property.

3. At least one side surface of a cold rolled low carbon steel sheet is electroplated with 1 to 15 g/m$^2$ of tin to provide a tin layer and then subjected to a reflowing treatment in which the steel sheet is heated at a temperature above the melting point of tin and subsequently the reflowed tin layer is plated with 0.0071 to 0.71 g/m$^2$ of zinc to provide a zinc layer superimposed on the tin layer, thereby providing a flow-brightened tin electroplated steel sheet having both excellent sulphur resisting property and excellent smudge resisting property.

In accordance with the invention, the amount of plated tin is limited to 1 to 15 g/m$^2$ owing to the following reasons.

Tin-plated steel sheet which is suited to the manufacture of cans or containers, particularly for food products, shall be highly corrosion resistant and free from surface defects and it is also desirable that the plated products have a luster finish exterior rendering it more attractive. For those purposes, the amount of plated tin is required to be more than 1 g/m$^2$. The above mentioned properties can be improved in response to an increase of the amount of plated tin, but the amount of plated tin more than 15 g/m$^2$ is not so much effective upon improvement in the above mentioned properties and hence the use of such amount of tin is not economical.

The above mentioned three kinds of tin-electroplated steel sheets each composed of a cold rolled low carbon steel sheet, electroplated tin layer and a zinc layer superimposed on the tin layer are further subjected to a chemical treatment so as to significantly improve the sulphur resisting property, corrosion resisting property and smudge resisting property.

The term "chemical treatment" is intended to include formation of a film of hydrate of chromium oxide on the tin-electroplated steel sheet by a conventional method of dipping the tin-electroplated steel sheet into an aqueous solution containing hexa valent chromium ion or spraying an aqueous solution containing hexa valent chromium ion onto the tin-electroplated steel sheet or electrolytically treating the tin-electroplated steel sheet in an aqueous solution containing hexa valent chromium ion.

In carrying out the invention, conventional operations such as electrolytic degreasing, rinsing, pickling and rerinsing are subjected to a cold rolled low carbon steel sheet and then electroplating the steel sheet with tin. Subsequently, the steel sheet is electroplated or chemically deposited with zinc before or after a reflowing step subjected to the tin layer, the amount of plated zinc being 0.0071 to 0.71 g/m$^2$, preferably 0.0355 to 0.355 g/m$^2$, more preferably 0.0355 to 0.142 g/m$^2$ thus providing an extremely thin zinc layer whose thickness is 0.001 to 0.1 $\mu$m, preferably 0.005 to 0.05 $\mu$m, more preferably 0.005 to 0.02 $\mu$m.

An example of a suitable zinc-plating treatment is as follows.

An electric potential is applied from an external source between a bath of zinc electrolyte having the following composition

| | |
|---|---|
| Zinc sulfate | 240 g/l |
| Ammonium chloride | 15 g/l |
| Aluminum sulfate | 30 g/l |

and a steel sheet to be plated and serving as a cathode for 0.1 to 10 seconds, the current density being 0.5 to 5 A/dm$^2$.

The reflowing treatment of the tin layer is effected before or after the superimposition of the extremely thin layer of zinc on the tin-electroplated layer by heating the tin layer at a temperature above the melting point of tin by means electric resistance heating and the like and subsequently cooling the tin layer.

This reflowing treatment serves to alloy tin with the steel sheet, while zinc superimposed on the tin layer is caused to partly diffuse into the tin layer and also to alloy zinc with the tin layer. Thus, the term "tin layer" includes 1. the tin layer per se,
2. the tin layer inclusive of tin contained in the tin-iron alloy, and
3. the tin layer inclusive of tin contained in the tin-iron alloy and tin diffused with the zinc layer.

In addition, the term "zinc layer" includes 1. the zinc layer per se, and
2. the zinc layer inclusive of zinc diffused with the tin layer.

Preferable chromate treatments are dipping the steel sheet into an aqueous solution of chromate having a small concentration (the concentration of $Cr^{6+}$ ion being 5 to 30 g/l), cathodic electrolytic treatment (electric quantity of 0.1 to 20 c/dm$^2$ with a current density of 0.5 to 20 A/dm$^2$) or cathodic-anodic electrolytic treatment (cathodic electrolytic treatment by means of electric quantity of 0.1 to 20 c/dm$^2$ with a current density of 0.5 to 20 A/dm$^2$ followed by anodic electrolytic treatment, the treated electrical quantity being 0.1 to 5 c/dm$^2$ with the current density of 0.1 to 5 A/dm$^2$). All of these treatments are capable of forming a non-crystal film of hydrate of chromium oxide and free from holes on the steel sheet based on the amount of chromium of 0.05 to 2.0 $\mu$g/cm$^2$, the surface of the steel sheet being passivated whereby the sulfur resisting property and the corrosion resisting property are significantly improved.

If the amount of chromium exceeds 2.0 $\mu$g/cm$^2$, the film of hydrate of chromium oxide becomes bluish. As a result, the plated products have a bad adhering property with paint to be coated thereon and have a bad luster finish.

The reasons why the tin-electroplated steel sheet according to the invention can improve its sulfur resisting property are not fully elucidated. It is conceivable, however, that the tin-plated steel sheet in touch with food products containing sulfide compounds produces on its surface zinc sulfide which is hardly solvable and stable in a uniform manner, thereby refraining tin sulfide from being produced. The zinc sulfide is colorless or white, so that the presence of zinc sulfide on the surface of the tin-electroplated steel sheet does not show any change in appearance which can be observed by naked eyes, and as a result, it is possible to maintain an initial luster of the tin-electroplated steel sheet.

As seen from the above, the invention is capable of preventing the tin-electroplated steel sheet from being discolored, and this eliminates a difficult problem of discoloring the surface of the tin-electroplated steel sheet which has been encountered with the conventional tin-electroplated steel sheet. The invention, therefore, provides a tin-electroplated steel sheet having an extremely excellent sulfur resisting property.

The more the amount of plated zinc exceeds 0.0071 g/m$^2$ and the larger the thickness of the zinc layer becomes, the more the surface characteristics such as the sulfur resisting property and the smudge resisting property are improved. On the other hand, if the tin-electroplated steel sheet is used for the manufacture of cans or containers for food products, care with respect to whether zinc effluent is good or toxic for health should be taken into consideration.

In general, zinc is contained in cereals with a rate of 2 to 10 ppm, in beans with a rate of 20 to 40 ppm, in vegetables with a rate of 2 to 10 ppm, in beefs with a rate of 50 to 70 ppm, in porks with a rate of approximately 50 ppm, in whale meat with a rate of approximately 10 ppm, in chicken meal with a rate of approximately 12 to 20 ppm, and in fishes with a rate of the order of 5 to 10 ppm.

In human body, zinc is contained in liver with a rate of 50 to 140 ppm, in pancreas with a rate of 30 ppm, and in blood with a rate of 6 to 7 ppm. In addition, zinc is also contained in carbonic anhydrase, insulin, certain kind of phosphatase and plays an important role of life phenomenon. As a result, children are required to take 0.3 mg of zinc per 1 Kg of their body-weight, while adult persons are required to take 10 to 15 mg of zinc per 1 Kg of their body-weight. At present, 15 ppm of zinc, 0.4 ppm of lead, 15 ppm of tin and 0.2 ppm of arsenic are allowed to be incorporated into a soft drink (150 ppm of tin for canned juice) under the Japanese Sanitary Laws. In addition, 200 ppm of zinc, 25 to 50 ppm of chromium, and 5 to 50 ppm of heavy metal (based on lead) and allowed to be incorporated into food products as their addition agent.

As a result, if cans or containers for soft drinks are manufactured by means of the tin-electroplated steel sheet according to the invention, the amount of plated zinc is required to be less than 0.14 g/m$^2$ which produces a zinc layer having a thickness of smaller than 0.02 $\mu$m for the purpose of preventing effluent from becoming exceeded the above mentioned allowable standard value. The above mentioned amount of plated zinc is calculated under such assumption that use is made of a 200 g can mainly used for cans for soft drinks (Inner diameter: 52.3 mm, Height: 104.3 mm, Interior capacity: 207.9 cc), and that zinc on the inner surface of the can is totally dissolved.

If cans or containers for food products in general are manufactured by means of the tin-electroplated steel sheet according to the invention, it is preferable for sanitary reasons to make the amount of plated zinc less than 0.71 g/m² which produces a zinc layer having a thickness of smaller than 0.1 μm. The above mentioned amount of plated zinc is calculated under such assumption that use is made of a No. 4 can mainly used for cans for fruits (Inner diameter: 741 mm, Height: 113.0 mm, Interior capacity: 454.4 cc), and that zinc on the inner surface of the can is totally dissolved.

In addition, if the amount of plated zinc exceeds 0.355 g/m², the soldering property and a luster finish becomes more or less degraded, so that it is preferable to make the amount of plated zinc less than 0.355 g/m².

The invention will now be described in greater detail with reference to the accompanying drawing and practical examples.

A sole FIGURE is a photograph showing standard ranks with which the smudge resisting property test results are evaluated.

The following practical examples show that the tin-electroplated steel sheet according to the invention has both excellent sulfur resisting property and excellent smudge resisting property.

EXAMPLE 1

A cold rolled low carbon steel sheet was subjected to electrolytic degreasing, rinsing, pickling and rerinsing operations. The thus treated steel sheet was electroplated with 5.6 g/m² of tin, which corresponds to No. 50 tin-electroplated steel sheet. Then, the tin-electroplated steel sheet was rinsed and electroplated with 0.0071 to 0.71 g/m² of zinc to provide a zinc coating of 0.001 to 0.1 μm thick. Subsequently, the zinc coated tin-electroplated steel sheet was subjected to rinsing and drying operations to provide a matte-finished tin-electroplated steel sheet.

The zinc plating was effected under the following conditions.

| | |
|---|---|
| Zinc plating bath: | |
| Zinc Sulfate | 240 g/l |
| Ammonium chloride | 15 g/l |
| Aluminum sulfate | 30 g/l |
| | pH. 3.5 |
| Temperature: | 40 to 50° C |
| Current density: | 0.5 to 10 A/dm² |
| Treating time: | 0.2 to 10 seconds. |

Alternatively, the matte-finished tin-electroplated steel sheet obtained by the above mentioned operations was subjected to a cathodic electrolytic chromate treatment under the following conditions.

| | |
|---|---|
| Treating bath: | |
| Sodium dichromate | 30 g/l |
| | pH 4.5 |
| Temperature | 45° C |
| Current density: | 5 A/dm² |
| Treating time: | 1 second. |

Thus, another matte-finished tin-electroplated steel sheet was provided.

The sulfur resisting property, smudge resisting property, corrosion resisting property and surface characteristic such as a paint adhering property of the above mentioned two kinds of matte-finished tin-electroplated steel sheets according to the invention were tested and compared with those of the conventional matte-finished tin-electroplated steel sheet subjected to the chemical treatment, the test results obtained being shown in the following Table 1.

| Items of Test | | Thickness of Zn-Plated Coating | | Not Painted Sheet | | Painted Sheet | | |
|---|---|---|---|---|---|---|---|---|
| Treating Method | | (μm) | (g/m²) | Flat Sheet | Deeply Drawned Sheet | Flat Sheet | Sheet Subjected to Erichsen Test | Deeply Drawned Sheet |
| Matte-finished Tin-Electroplated Steel Sheet | Sn-electroplating ↓ Zn-plating | 0.001 | 0.0071 | Δ | Δ | Δ | Δ | Δ |
| | | 0.005 | 0.0355 | o | o | o | Δ | Δ |
| | | 0.01 | 0.071 | o | o | o | o | o |
| | | 0.05 | 0.355 | o | o | o | o | o |
| | | 0.1 | 0.71 | o | o | o | o | o |
| According to the Invention | Sn-Electroplating ↓ Zn-Plating ↓ Chemical Treatment | 0.001 | 0.0071 | o | o | o | o | Δ |
| | | 0.005 | 0.0355 | o | o | o | o | o |
| | | 0.01 | 0.071 | o | o | o | o | o |
| | | 0.05 | 0.355 | o | o | o | o | o |
| | | 0.01 | 0.71 | o | o | o | o | o |
| Conventional Matte-finished Tin-Electroplated Steel Sheet Sn-Electroplating ↓ Chemical Treatment | | | | x | # | Δ | # | # |

-continued

| Treating Method | | Items of Test: Thickness of Zn-Plated Coating (μm) | (g/m²) | Smudge Resisting Property: Immediately After Manufacturing of Sheet | Sheet After Burning at 185° C For 15 min. | Sheet Subjected to Salt Spray Test | Paint Adhering Property: Flat Sheet | Deeply Drawned sheet | Amount of Cr on Surface of Sheet (μg/cm²) |
|---|---|---|---|---|---|---|---|---|---|
| Matte-finished Tin-Electro plated Steel Sheet | Sn-Electroplating ↓ Zn-plating | 0.001 | 0.0071 | 0 | 3 | 90 | 0 | 0 | 0 |
| | | 0.005 | 0.0355 | 0 | 3 | 80 | 0 | 0 | 0 |
| | | 0.01 | 0.071 | 0 | 1 | 80 | 0 | 0 | 0 |
| | | 0.05 | 0.355 | 0 | 1 | 60 | 0 | 0 | 0 |
| | | 0.1 | 0.71 | 0 | 1 | 50 | 0 | 0 | 0 |
| According to the Invention | Sn-Electroplating ↓ Zn-plating ↓ Chemical Treatment | 0.001 | 0.0071 | 0 | 3 | 60 | 0 | 0 | 0.38 |
| | | 0.005 | 0.0355 | 0 | 2 | 40 | 0 | 0 | 0.37 |
| | | 0.01 | 0.071 | 0 | 1 | 20 | 0 | 0 | 0.43 |
| | | 0.05 | 0.355 | 0 | 1 | 10 | 0 | 0 | 0.41 |
| | | 0.1 | 0.71 | 0 | 1 | 5 | 0 | 0 | 0.45 |
| Conventional Matte-finished Tin-Electroplated Steel Sheet Sn-Electroplating ↓ Chemical Treatment | | | | 0 | 4 | 80 | 0 | 0 | 0.40 |

The testing method and the evaluating method were effected as follows.

Sulfur Resisting Property Test

The sulfur resisting property test was effected on the matte-finished tin-electroplated steel sheet according to the invention with or without subjected to the chemical treatment and coated with or without epoxyphenol paint, the painted steel sheet being further dried by baking. For the sake of comparison, the sulfur resisting property test was also effected on the conventional matte-finished tin-electroplated steel sheet subjected to the chemical treatment and coated with or without epoxyphenol paint, the painted steel sheet being further dried by baking.

As to the painted sheet, the sulfur resisting property test was effected on the flat sheet, on the deformed sheet extruded for a distance of 5 mm by Erichsen test (the painted surface is made convex) and on the cup-shaped sheet subjected to the deep drawing (the painted surface is made an inner surface of the cup whose diameter is 28 mm and height is 17 mm).

The degree of discoloration caused by sulfurization was determined by naked eyes and evaluated on the basis of the following standards.

∘ — Not changed at all.
o — One portion is discolored in a hardly discernible degree.
Δ — One portion is slightly discolored.
× — Total surface is slightly discolored.
— Total surface is excessively discolored.

Smudge Resisting Property Test

A filter paper was urged against a specimen to be tested under a load of 500 g and reciprocated for 10 times. An amount of smudge adhered to the filter paper was evaluated with reference to six standard ranks as shown in a photograph of FIG. 1 in which reference numeral 0 designates no generation of smudge on the filter paper and 1, 2, 3 . . . 5 show generation of smudge gradually increasing in amount.

In this smudge resisting property test, the test piece was burnt at a temperature of 185° C, which corresponds to a baking temperature of a tin-plated steel during its printing process and the amount of generation of smudge was evaluated on the basis of the above mentioned standard ranks shown in the photograph of the accompanying drawing.

Salt Spray Test

Salt water was sprayed upon the test pieces for 20 hours in accordance with provisions of JIS Z2371-1955 (ASTM B117-62) and a rate of generation of red rust in % was measured to evaluate the effect according to the invention.

Paint Adhering Property Test

The test piece was coated with 45 mg/dm² of epoxyphenol paint and dried by baking at 200° C for 10 minutes. The paint coated layer of the flat test piece was formed with cross cuts by means of a sharp cutting tool, the cross cuts extending to the substrate of the paint coated layer. The paint adhering property of the thus treated test piece was measured by means of a "Scotch-tape" test. On the one hand, the paint coated test piece was subjected to the deep drawing to provide a cup-shaped test piece with its paint coated layer faced outwardly, the cup having an outer diameter of 28 mm and a height of 17 mm. The paint adhering property of the thus treated test piece was also measured by means of the Scotch-tape test. The paint adhering property was measured on the basis of $\sqrt{\text{That area of the paint coated layer which is peeled off from its substrate (\%)}}$ and ranked 0 (no peeling off) to 10 (totally peeled off).

As seen from the Table 1, the sulfur resisting property of the matte-finished tin-electroplated steel sheet with or without painted according to the invention is far superior to that of the conventional matte-finished tin-electroplated steel sheet. In addition, the smudge resisting property of the matte-finished tin-electroplated steel sheet after burning according to the invention is significantly improved if compared with that of the conventional matte-finished tin-electroplated steel sheet.

The salt spray test has yielded the result that the matte-finished tin-electroplated steel sheet according to the invention has a rate of producing red rust which is smaller than that of the conventional matte-finished tin-electroplated steel sheet.

The table 1 also shows that the chemical treatment plays a role of further improving the sulfur resisting property, smudge resisting property and rate of producing red rust of the matte-finished tin-electroplated steel sheet according to the invention.

EXAMPLE 2

A cold rolled low carbon steel sheet was subjected to electrolytic degreasing, rinsing, pickling and rerinsing operations.

The thus treated steel sheet was electroplated with 5.6 g/m² of tin, which corresponds to No. 50 tin-electroplated steel sheet. Then, the tin-electroplated steel sheet was rinsed and electroplated with 0.0071 to 0.71 g/m² of zinc to provide a zinc coating of 0.001 to 0.1 μm thick with the aid of the zinc sulfate plating bath which was used in the Example 1. Subsequently, the zinc coated tin-electroplated steel sheet was subjected to rinsing, reflowing and quenching operations to provide a flow-brightened tin-electroplated steel sheet.

In the present example, the reflowing operation was effected at 280° C by means of an electric resistance heating method.

Alternatively, the flow-brightened tin-electroplated steel sheet obtained by the above mentioned operations was subjected to a cathodic electrolytic chromate treatment under the following conditions.

| | |
|---|---|
| Treating bath: | |
| Sodium dichromate | 30 g/l |
| | pH 4.5 |
| Temperature | 45° C |
| Current density | 5 A/dm² |
| Treating time | 1 second. |

Thus, another flow-brightened tin-electroplated steel sheet was provided.

A third kind of flow-brightened tin-electroplated steel sheet was provided by subjecting to the above mentioned cathodic electrolytic chromate treated steel sheet an anodic electrolytic chromate treatment under the following conditions.

| | |
|---|---|
| Treating bath: | |
| Sodium dichromate | 30 g/l |
| | pH 4.5 |
| Temperature | 45° C |
| Current density | 1 A/dm² |
| Treating time | 0.25 second |

A fourth kind of flow-brightened tin-electroplated steel sheet was provided by subjecting to the above mentioned reflowed steel sheet a dip chromate treatment under the following conditions.

| | |
|---|---|
| Treating bath: | |
| Chromic anhydride | 30 g/l |
| | pH 0.7 |
| Temperature | 50° C |
| Treating time | 1 second |

The surface characteristics inclusive of the sulfur resisting property, smudge resisting property, corrosion resisting property and paint adhering property of the above mentioned four kinds of flow-brightened tin-electroplated steel sheets according to the invention were tested and compared with those of the conventional flow-brightened tin-electroplated steel sheet obtained by the successive steps of tin-electroplating, reflowing and chemical treatment, the test results yielded being shown in the following Table 2.

Table 2

| Treating Method | Items of Tests: Thickness of Zn-Plated Coating (um) | (g/m²) | Sulfur Resisting Property: Not Painted Sheet: Flat Sheet | Deeply Drawned Sheet | Painted Sheet: Flat Sheet | Sheet Subjected to Erichsen Test | Deeply Drawned Sheet | Smudge Resisting Property: Immediately After Manufacturing of sheet | Sheet After Burning at 185° C For 60 min. | Sheet Subjected to Salt Spray Test |
|---|---|---|---|---|---|---|---|---|---|---|
| Sn-Electroplating | 0.001 | 0.0071 | Δ | Δ | Δ | Δ | x | 0. | 3 | 90 |
| ↓ | 0.005 | 0.0355 | Δ | Δ | o | Δ | Δ | 0 | 2 | 70 |
| Zn-plating | 0.01 | 0.071 | o | o | o | o | o | 0 | 1 | 50 |
| ↓ | 0.01 | 0.355 | o | o | o | o | o | 0 | 1 | 50 |
| Reflowing | 0.1 | 0.71 | o | o | o | o | o | 0 | 1 | 20 |

Table 2-continued

| | | | | | | | | | | | |
|---|---|---|---|---|---|---|---|---|---|---|---|
| | Sn-Electro-plating | 0.001 | 0.0071 | Δ | Δ | Δ | x | x | 2 | 3 | 70 |
| | ↓ Zn-plating | 0.005 | 0.0355 | o | o | o | o | o | 0 | 1 | 50 |
| | ↓ Reflowing | 0.01 | 0.071 | o | o | o | o | o | 0 | 1 | 10 |
| | ↓ | 0.05 | 0.355 | o | o | o | o | o | 0 | 1 | 5 |
| Flow-brightened Tin-Electro-plated | ↓ Chemical Treatment* | 0.1 | 0.71 | o | o | o | o | o | 0 | 1 | 0 |
| Steel Sheet According to the Invention | Sn-Electro-plating ↓ Zn-Plating ↓ Reflowing ↓ Chemical Treatment** | 0.01 | 0.071 | o | o | o | o | o | 0 | 0 | 20 |
| | Sn-Electro-plating ↓ Zn-Plating ↓ Reflowing ↓ Chemical Treatment*** | 0.01 | 0.071 | o | o | o | o | o | 0 | 1 | 40 |
| Conventional Flow-brightened Tin-Electroplated Steel Sheet | Sn-Electroplating ↓ Reflowing ↓ Chemical Treatment | | | x | # | Δ | x | # | 2 | 5 | 80 |

| Treating Method | Thickness of Zn-Plated Coating (um) | (g/m²) | Paint Adhering Property: Flat Sheet | Deeply Drawned Sheet | Sheet Subjected To Hot Water Test Number of Pinholes/cm² | Thio-Cyanate Value (mg/dm²) | I.S.V (μg/cm²) | Raised Height of Solder (mm) | Amount of Cr On Surface of Sheet (μg/cm²) | Surface appearance (Luster) |
|---|---|---|---|---|---|---|---|---|---|---|
| Sn-Electro-plating | 0.001 | 0.0071 | 2 | 0 | 10–30 | 5.70 | 0.28 | 14 | 0 | Good |
| ↓ | 0.005 | 0.0355 | 0 | 0 | 10–30 | 5.53 | 0.17 | 14 | 0 | Good |

Table 2-continued

| | | | | | | | | | | | |
|---|---|---|---|---|---|---|---|---|---|---|---|
| | Zn-plating ↓ Reflowing | 0.01 | 0.071 | 0 | 0 | 10–30 | 5.25 | 0.12 | 13 | 0 | Good |
| | | 0.05 | 0.355 | 0 | 0 | 0–10 | 5.40 | 0.10 | 13 | 0 | Good |
| | | 0.1 | 0.71 | 0 | 0 | 0–10 | 5.17 | 0.09 | 13 | 0 | Slightly Dull |
| Flow-brightened Tin-Electro-plated | Sn-Electro-plating ↓ Zn-plating ↓ Reflowing ↓ Chemical Treatment* | 0.001 | 0.0071 | | | 0–10 | 5.22 | 0.29 | 13 | 0.35 | Good |
| | | 0.005 | 0.0355 | | | 0–10 | 5.49 | 0.18 | 14 | 0.36 | Good |
| | | 0.01 | 0.071 | | | 0–10 | 3.43 | 0.39 | 15 | 0.45 | Good |
| | | 0.05 | 0.355 | | | 0–10 | 3.01 | 0.48 | 15 | 0.49 | Good |
| | | 0.1 | 0.71 | | | 0–10 | 2.39 | 0.31 | 6 | 0.52 | Slightly Dull |
| Steel Sheet According to the Invention | Sn-Electro-plating ↓ Zn-plating ↓ Reflowing ↓ Chemical Treatment** | 0.01 | 0.071 | 2 | 0 | 10–30 | 3.50 | 0.31 | 12 | 0.42 | Good |
| | Sn-Electro plating ↓ Zn-plating ↓ Reflowing ↓ Chemical Treatment*** | | | 0 | 0 | 0–10 | 3.72 | 0.41 | 13 | 0.05 | Good |
| Conventional flow brightened Tin-Electroplated Steel Sheet | Sn-Electroplating ↓ Reflowing ↓ Chemical Treatment | | | 3 | 0 | 10–30 | 5.54 | 0.58 | 12 | 0.35 | Good |

*Conditions of chemical treatments. Cathodic electrolytic treatment with Sodium dichromate 30 g/l, pH 4.5, temperature 45° C, Cathode current density 5 A/dm², treating time 1 second.

**Cathodic electrolytic treatment with Sodium dichromate 30 g/1, pH 4.5, temperature 45° C, Cathode current density 5 A/dm², treating time 1 second followed by anodic electrolytic treatment with sodium dichromate 30 g/t, pH 4.5, temperature 45° C, anode current density 1 A/dm², treating time 0.25 second.

***Dip chromate treatment with chromic anhydride 30 g/l, pH 0.7, temperature 50° C, treating time 1 second.

In order to obtain the test results shown in the above Table 2, the sulfur resisting property test, smudge resisting property test, salt spray test and paint adhering property test as well as the method of evaluating these test results were effected in the same manner as those described with reference to the example 1.

As seen from the Table 2, the sulfur resisting property of the flow-brightened tin-electroplated steel sheet with or without painted according to the invention and also the smudge resisting property thereof are far superior to those of the conventional flow-brightened tin-electroplated steel sheet. In addition, the salt spray test and thiocyanate test have yielded the result that the flow-brightened tin-electroplated steel sheet according to the invention has an improved corrosion resisting property which is a representative of general surface characteristics of the above steel sheet.

The Table 2 also shows that the flow-brightened tin-electroplated steel sheet subjected to the chemical treatments according to the invention is significantly corrosion resistant.

EXAMPLE 3

A cold rolled low carbon steel sheet was subjected to electrolytic degreasing, rinsing, pickling and rerinsing operations. The thus treated steel sheet was electroplated with 5.6 g/m² of tin, which corresponds to No. 50 tin-electroplated steel sheet. Then, the tin-electroplated steel sheet was rinsed and subjected to reflowing treatment at 280° C by means of an electric resistance heating method and subsequently quenched. The thus reflowed steel sheet was electroplated with 0.0071 to 0.71 g/m² of zinc to provide a zinc coating of 0.001 to 0.1 μm thick with the aid of the zinc sulfate plating bath which was used in the Example 1. Subsequently, the zinc coated tin-electroplated steel sheet was subjected to rinsing and drying to provide a flow-brightened tin-electroplated steel sheet.

Alternatively, the flow-brightened tin-electroplated steel sheet obtained by the above mentioned successive steps of tin-electroplating, reflowing, quenching and zinc-plating was subjected to a cathodic electrolytic chromate treatment under the following conditions.

| | |
|---|---|
| Treating bath: | |
| Sodium dichromate | 30 g/l |
| | pH 4.5 |
| Temperature | 45° C |
| Current density | 5 A/dm² |
| Treating time | 1 second |

Thus, another flow-brightened tin-electroplated steel sheet was provided by the above mentioned successive steps of tin-electroplating, reflowing, quenching, zinc-plating and chemical treatment.

The surface characteristics inclusive of the sulfur resisting property, smudge resisting property, corrosion resisting property and paint adhering property of the above mentioned two kinds of flow-brightened tin-electroplated steel sheets according to the invention were tested and compared with those of the conventional flow-brightened tin-electroplated steel sheet obtained by the successive steps of tin-electroplating, reflowing and chemical treatment, the test results yielded being shown in the following Table 3.

Table 3

| Treating Method | | Items of Tests: Thickness of Zn-plated coating (μm) | (g/m²) | Sulfur Resisting Property: Not painted sheet: Flat sheet | Not painted sheet: Deeply Drawned sheet | Painted sheet: Flat sheet | Painted sheet: Sheet subjected to Erichsen test | Painted sheet: Deeply Drawned sheet |
|---|---|---|---|---|---|---|---|---|
| Flow-brightened | Sn-Electroplating | 0.001 | 0.0071 | Δ | x | Δ | Δ | x |
| | ↓ | 0.005 | 0.0355 | Δ | Δ | Δ | Δ | Δ |
| tin-electroplated | Reflowing | 0.01 | 0.071 | ∘ | o | o | Δ | o |
| | ↓ | 0.05 | 0.355 | ∘ | o | ∘ | ∘ | ∘ |
| steel sheet | Zn-plating | 0.1 | 0.71 | ∘ | o | ∘ | ∘ | ∘ |
| according to | Sn-electroplating | 0.001 | 0.0071 | Δ | x | Δ | Δ | Δ |
| | ↓ | 0.005 | 0.0355 | o | Δ | o | 0 | o |
| the invention | Reflowing | 0.01 | 0.071 | ∘ | o | ∘ | ∘ | o |
| | ↓ | 0.05 | 0.355 | ∘ | ∘ | ∘ | ∘ | o |
| | Zn-plating | 0.1 | 0.71 | ∘ | ∘ | ∘ | ∘ | o |
| | ↓ | | | | | | | |
| | Chemical Treatment | | | | | | | |

Table 3-continued

| | | | | | | | | | | |
|---|---|---|---|---|---|---|---|---|---|---|
| Conventional flow-brightened tin-electroplated steel sheet<br>Sn-electroplating<br>↓<br>Reflowing<br>↓<br>Chemical treatment | | | | x | # | Δ | x | # | | |

| Treating method | | Thickness of Zn-plated coating (μm) | (g/m²) | Smudge resisting property: Immediately after manufacturing of sheet | Sheet after burning at 185° C for 60 min. | Sheet subjected to salt spray test | Paint adherence property: Flat sheet | Deeply drawned sheet | Amount of Cr on Surface of sheet (μg/cm²) | Surface appearance (Luster) |
|---|---|---|---|---|---|---|---|---|---|---|
| Flow-brightened | Sn-electroplating | 0.001 | 0.0071 | 0 | 3 | 90 | 0 | 0 | 0 | Good |
| | ↓ | 0.005 | 0.0355 | 0 | 3 | 80 | 0 | 0 | 0 | Good |
| tin-electroplated | | 0.01 | 0.071 | 0 | 1 | + | 0 | 0 | 0 | Good |
| | Reflowing | 0.05 | 0.355 | 0 | 1 | 20 | 0 | 0 | 0 | Slightly dull |
| steel sheet | ↓ | 0.1 | 0.71 | 0 | | 20 | 0 | 0 | 0 | Dull |
| | Zn-plating | | | | | | | | | |
| according to | Sn-electroplating | 0.001 | 0.0071 | 2 | 3 | 60 | 0 | 0 | 0.32 | Good |
| | ↓ | 0.005 | 0.0355 | 1 | 3 | 40 | 0 | 0 | 0.35 | Good |
| the invention | Reflowing | | | | | | | | | |
| | ↓ | 0.01 | 0.071 | 0 | 1 | 5 | 0 | 0 | 0.33 | Good |
| | Zn-plating | 0.05 | 0.355 | 0 | 1 | 0 | 0 | 0 | 0.41 | Slightly dull |
| | ↓ | 0.1 | 0.71 | 0 | 1 | 0 | 0 | 0 | 0.45 | Dull |
| | Chemical Treatment | | | | | | | | | |
| Conventional Flow-brightened tin-electroplated steel sheet<br>Sn-electroplating<br>↓<br>Reflowing<br>↓<br>Chemical treatment | | | | 2 | 5 | 80 | 3 | 0 | 0.35 | Good |

In order to obtain the test results shown in the above Table 3, the sulfur resisting property test, smudge resisting property test, salt spray test and paint adhering property test as well as the method of evaluating these test results were effected in the same manner as those described with reference to the example 1.

As seen from the table 3, the sulfur resisting property of the flow-brightened tin-electroplated steel sheet with or without painted according to the invention and also the smudge resisting property thereof are far superior to those of the conventional flow-brightened tin-electroplated steel sheet. In addition, the salt spray test has yielded the result that the flow-brightened tin-electroplated steel sheet according to the invention has an improved corrosion resisting property which is a representative of general surface characteristics of the above steel sheet.

The table 3 also shows that the flow-brightened tin-electroplated steel sheet subjected to the chemical treatment is significantly corrosion resistant.

As explained hereinbefore, the use of measures described according to the invention ensures protection of the plated product against discoloration due to sulfurization and keeps it in good appearance even when it is used for cans or containers for food products rich in albuminous substances such as fishes, meats or powdered milk or for food products containing sulfide such as asparagus and further provides the important advantage that there is no risk of the printed surface of the plated product being deteriorated and contaminated due to smudge caused by tin powder or its oxide which has inevitably been adhered to the surface of the plated product during the operation of baking the printed or painted surface of the plated product.

What is claimed is:

1. A tin-electroplated steel sheet having an excellent sulfur resisting property and excellent smudge resisting property, comprising a cold rolled low carbon steel sheet substrate, a layer consisting of 1 to 15 g/m$^2$ of electroplated tin, said layer being electroplated upon at least one side surface of said substrate and a layer consisting of 0.0071 to 0.71 g/m$^2$ of zinc, said layer being plated upon said tin layer.

2. The tin-electroplated steel sheet as claimed in claim 1, wherein said amount of zinc plated upon said tin layer is 0.0355 to 0.355 g/m$^2$.

3. The tin-electroplated steel sheet as claimed in claim 1, wherein said amount of zinc plated upon said tin layer is 0.0355 to 0.142 g/m$^2$.

4. The tin-electroplated steel sheet as claimed in claim 1 and further comprising a film consisting of hydrate of chromium oxide containing less than 2.0 $\mu$g/cm$^2$ of chromium and superimposed upon said zinc layer.

5. A method of manufacturing a tin-electroplated steel sheet having an excellent sulfur resisting property and excellent smudge resisting property, comprising the steps of electroplating at least one side surface of a cold rolled low carbon steel sheet substrate with 1 to 15 g/m$^2$ of tin to provide a tin coating, and plating said tin coating with 0.0071 to 0.71 g/m$^2$ of zinc to provide a zinc coating superimposed upon said tin coating.

6. The method as claimed in claim 5, wherein said amount of zinc plated upon said tin layer is 0.0355 to 0.355 g/m$^2$.

7. The method as claimed in claim 5, wherein said amount of zinc plated upon said tin layer is 0.0355 to 0.142 g/m$^2$.

8. The method as claimed in claim 5 and further comprising a step of chemically treating said tin-electroplated and zinc plated steel sheet to provide a film consisting of hydrate of chromium oxide containing less than 2.0 $\mu$g/cm$^2$ of chromium thereon.

9. The method as claimed in claim 5 and further comprising a step of reflowing said tin-electroplated and zinc plated steel sheet.

10. The method as claimed in claim 9, wherein said amount of zinc plated upon said tin layer is 0.0355 to 0.355 g/m$^2$.

11. The method as claimed in claim 9, wherein said amount of zinc plated upon said tin layer is 0.0355 to 0.142 g/m$^2$.

12. The method as claimed in claim 9 and further comprising a step of chemically treating said tin-electroplated, zinc plated and reflown steel sheet to provide a film consisting of hydrate of chromium oxide containing less than 2.0 $\mu$g/cm$^2$ of chromium thereon.

13. A method of manufacturing a tin-electroplated steel sheet having an excellent sulfur resisting property and excellent smudge resisting property, comprising the steps of electroplating at least one side surface of a cold rolled low carbon steel sheet substrate with 1 to 15 g/m$^2$ of tin to provide a tin coating, and reflowing and then plating with 0.0071 to 0.71 g/m$^2$ of zinc to provide a zinc coating upon the reflowed tin coating.

14. The method as claimed in claim 13, wherein said amount of zinc plated upon said tin layer is 0.0355 to 0.355 g/m$^2$.

15. The method as claimed in claim 13, wherein said amount of zinc plated upon said tin layer is 0.0355 to 0.142 g/m$^2$.

16. The method as claimed in claim 13 and further comprising a step of chemically treating said tin-electroplated, reflown and zinc plated steel sheet to provide a film consisting of hydrate of chromium oxide containing less than 0.2 $\mu$g/cm$^2$ of chromium thereon.

* * * * *